US005398876A

United States Patent [19]

Reinhall

[11] Patent Number: 5,398,876

[45] Date of Patent: Mar. 21, 1995

[54] APPARATUS AND METHOD FOR REFINING PULP STOCK

[76] Inventor: Ulf B. Reinhall, 2112 E. Hamlin St., Seattle, Wash. 98112

[21] Appl. No.: 91,681

[22] Filed: Jul. 15, 1993

[51] Int. Cl.[6] ..... B02C 7/14

[52] U.S. Cl. ..... 241/28; 241/37; 241/239.2

[58] Field of Search ..... 241/28, 37, 63, 259.2, 241/259.3, 259.1, 261.2, 261.3

[56] References Cited

U.S. PATENT DOCUMENTS

| | | | |
|---|---|---|---|
| 2,964,250 | 12/1960 | Asplund | 241/256 |
| 2,997,704 | 8/1961 | Gordon et al. | 340/347 |
| 3,212,721 | 10/1965 | Asplund et al. | 241/37 |
| 3,684,200 | 8/1972 | Reinhall | 241/256 |
| 3,717,308 | 2/1973 | Reinhall | 241/244 |
| 3,737,109 | 6/1973 | Johansson | 241/37 |
| 3,961,757 | 6/1976 | Berggren | 241/37 X |
| 4,073,442 | 2/1978 | Virving | 241/37 |
| 4,253,613 | 3/1981 | Reinhall | 241/244 |
| 4,283,016 | 8/1981 | Reinhall | 241/21 |
| 4,402,463 | 9/1983 | Kahmann et al. | 241/37 |

*Primary Examiner*—Douglas D. Watts
*Attorney, Agent, or Firm*—Dowell & Dowell

[57] ABSTRACT

This invention relates to a method of refining pulp stock in which the pulp material to be ground is introduced into a grinding space located between a first rotatable grinding device carried by a shaft and being axially displaceable by a servo motor, and a second non-rotatable grinding device. The servo motor is actuated by pressurized fluid for adjusting and controlling the grinding space, producing a grinding pressure between the first and the second grinding devices and for preventing axial displacement of the first rotatable grinding device relative to the second non-rotatable grinding device in response to fluctuating axial grinding forces. The second non-rotatable grinding device comprises a plurality of concentrically arranged annular grinding members, at least one of which is axially adjustable by a setting device.

25 Claims, 15 Drawing Sheets

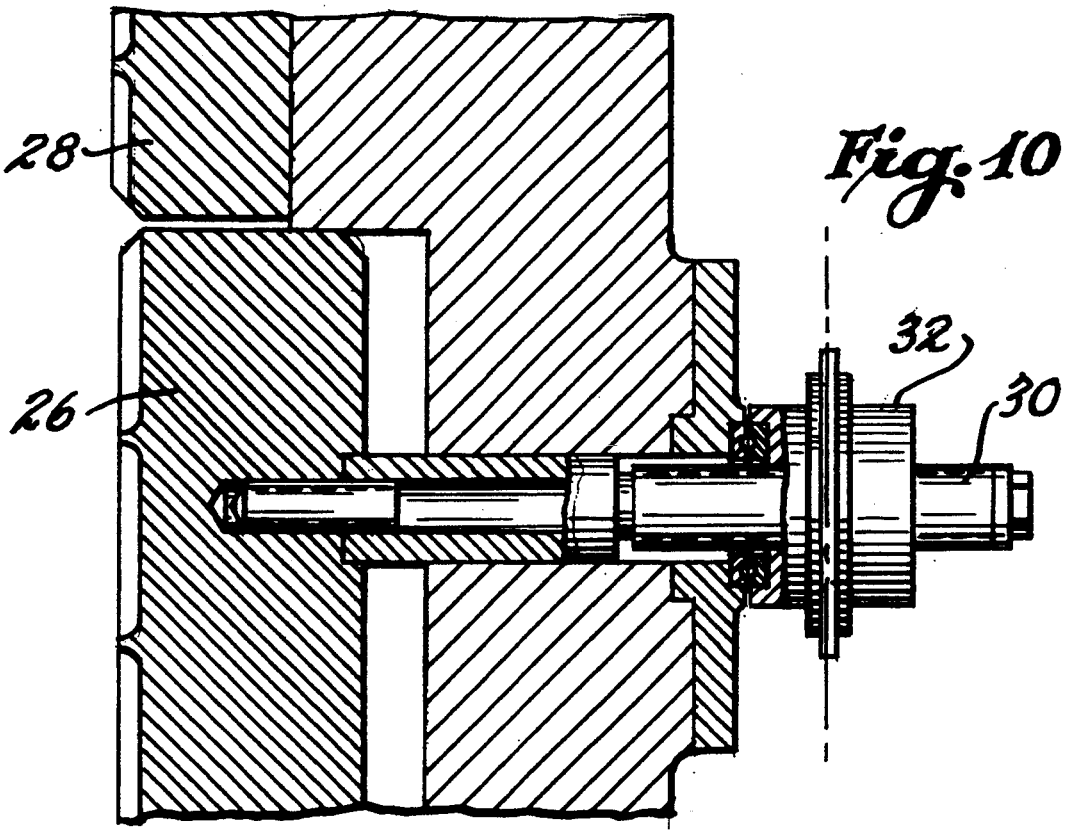
Fig. 10
Fig. 11
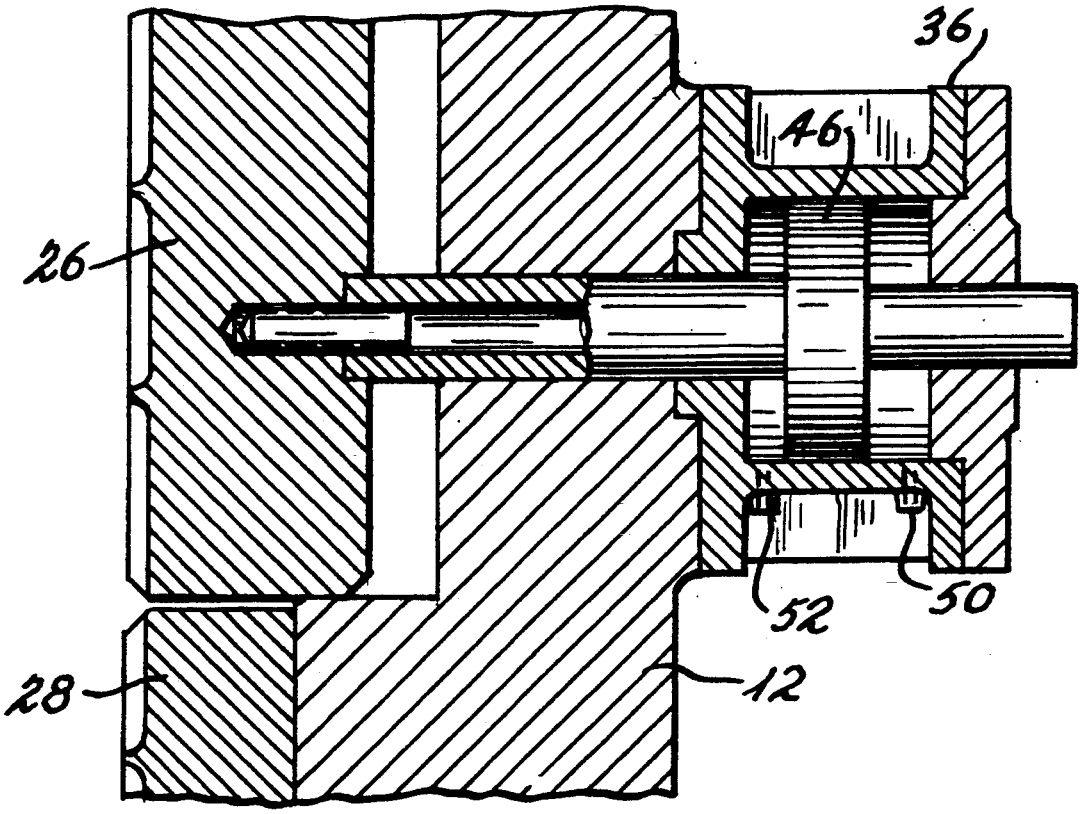

APPARATUS AND METHOD FOR REFINING PULP STOCK

BACKGROUND OF THE INVENTION

FIELD OF THE INVENTION

This invention relates to a method of refining pulp stock in which the pulp material to be ground is introduced into a grinding space located between a first rotatable grinding device carried by a shaft and being axially displaceable by a servo motor, and a second non-rotatable grinding device. The servo motor is actuated by pressurized fluid for adjusting and controlling the grinding space, producing a grinding pressure between the first and the second grinding devices, and for preventing axial displacement of the first rotatable grinding device relative to the second non-rotatable grinding device in response to fluctuating axial grinding forces. The second non-rotatable grinding device includes a plurality of concentrically arranged annular grinding members, at least one of which is axially adjustable by a setting device.

The invention also relates to a grinding apparatus which includes grinding discs in opposed relationship, and forming a grinding space therebetween. A rotatable grinding member is carried by an axially displaceable shaft, and the axial position of the shaft determines the size of the grinding space. The space is controlled and maintained by a servo motor, as exemplified in U.S. Pat. No. 2,964,250. The stationary grinding disc comprises two or more concentrically arranged, annular members for grinding disc elements, which are axially adjustable relative to each other to form the most efficient contour of the grinding space.

The grinding product, such as lignocellulosic material from wood chips or the like, is fed into an opening at the grinding space and forced through the grinding discs primarily in an outward radial or spiral direction by centrifugal forces in combination with the feeding effect of the grinding disc patterns used. During this forced passage by the grinding discs, the treated material generates a high grinding pressure which is transferred to the grinding members as axial forces that are absorbed and counteracted by a rotary side hydraulic main servo motor acting on the rotatable shaft with its grinding member and, on the stator side, by set screws of the adjustable annular grinding members and directly by the stator base of the non-adjustable part of the stationary grinding member.

HISTORY OF RELATED ART

Hydraulic and/or mechanical methods to adjust the axial position of one or more concentrically arranged annular holder members for non-rotating grinding disc elements have been used in different applications as exemplified by U.S. Pat. Nos. 3,684,200, 4,283,016 and 4,253,613.

With the use of increasingly larger refiners with connected power in excess of 60,000 HP, however, the generated axial grinding forces have reached levels far above 100 tons. This axial load is directed to, and is equal for, both the rotating and the non-rotating grinding members, and has necessitated the use of increasingly sophisticated mechanisms for the independent axial adjustment of the non-rotary annular grinding members.

The previously used threaded set screws or other threaded components for adjusting the axial positions of the different non-rotating grinding elements are, with these increasing axial loads, no longer acceptable due to the associated heavy frictional turning resistance and excessive wear.

In order to minimize the frictional forces and wear of the set screws, ball and roller set screws having different designs have been used. These devices are expensive, however, and require the frequent repair of their internal components that absorb the axial forces.

Hydraulically operated or assisted stator position control systems with separate and independent hydraulic systems as exemplified by U.S. Pat. No. 3,684,200, have also been used and in some cases have provided acceptable performance. But, compared to the system of this invention, the known systems are complicated and expensive.

The use of hydraulic booster cylinders for the stator set screws is described in U.S. Pat. No. 4,253,613. These hydraulic boosters, however, operate with a preset hydraulic pressure, and generate a constant set axial force, which unloads the threaded set screws but does not follow the variation in axial forces generated during the grinding process. The set screws will thus carry the difference in axial load between the actual grinding load and the preset hydraulic force, in the direction toward the rotating grinding elements, which in turn have to be set to a level well above the maximum grinding load in order to prevent unwanted and uncontrolled outward movement of the controlled non-rotating grinding element.

Furthermore, the position of the controlled non-rotary grinding member is adjusted during start-up procedures, and when the axial grinding forces are zero or slightly greater, the set screws will carry the full preset force of the hydraulic boosters. Thus, the system will not protect the stator set screws from the heavy peak loads, but will only lower the average performance loads. Reference is also made to U.S. Pat. Nos. 2,964,250 and 3,717,308 for relevant disclosures.

SUMMARY OF THE INVENTION

The present invention has been made in view of the above inadequacies of the prior art and has as a principal object to provide a method and apparatus for refining pulp stock permitting counterbalancing of all of the varying axial forces exerted on the controlled non-rotatable grinding member.

The method in accordance with the present invention comprises absorbing and counterbalancing fluctuating axial forces from a grinding process that are projected on setting devices, by using the pressure of a pressurized fluid of a rotating side servo motor to directly or indirectly provide a counter pressure on an axially adjustable non-rotatable grinding member in order to relieve the setting devices from the axial forces.

In accordance with an embodiment of the present invention, at least one annular, non-rotating grinding element is axially balanced and actuated by a set of hydraulic servo motors working in tandem, either directly or indirectly, with the main servo motor for the rotating shaft, and the axial movements of the annular grinding member are controlled and restricted by adjustable stop means.

The servo motors are arranged at spaced intervals about the circumference of the annular grinding member to be controlled, or they may be placed separately intermediate, or in combination with, an adjustable stop for the annular grinding member.

The stator servo motors may be reduced versions of the main rotating side servo motor; i.e., have the same ratios between front and rear piston areas which when added together, have a total area equal to the portion of the total refiner axial load, carried by the controlled annular grinding member.

The stator servo motors are hydraulically connected or governed, directly or indirectly, by the main shaft servo motor, and thus always are able to jointly generate a counterbalancing axial force that corresponds to the portion of total refiner axial load exerted on the controlled annular stator grinding member. By adjustment of the servo motor areas and/or supplied pressure, however, it is possible to generate a pro rata axial balancing force that is either lower or higher than the actual grinding forces exerted on the controlled annular stator grinding member, but which maximum force difference falls within a limit for safe operation of the adjustable stop.

The above-described principal arrangement is also applicable for grinding equipment using one-sided servomotors; i.e., pistons having only one side subjected to a hydraulic pressure medium. In such instances, the servomotors for the annular stator grinding members also are one-sided and set to operate in the opposite direction relative to the main shaft servomotor.

One-sided servo motors for counterbalancing the axial forces exerted on the annular non-rotating grinding member may also be used with two-sided main shaft servo motors if a hydraulic pressure converter is used to produce a pressure corresponding to the resultant forces of the two-sided servo motor.

Other types of adjustable pressure converters, namely mechanical, hydraulic, pneumatic, electric, electronic or computer-controlled pressure converters/regulators, may also be used to adjust the pressure levels from the shaft main servo motor, introduced to the stator side servo motors in order to conform more closely to the available plunger area and the change of axial fores absorbed by the controlled annular grinding member, which may occur with different types of grinding tools and/or refining processes.

A separate hydraulic pressure medium supply for the stator servo motors may also be used. In such instances, the pressure transferred to the stator servo motors is momentarily governed by the fluctuating pressure levels maintained in the shaft main servo motor, either directly or indirectly, through the use of the above-described pressure converters and/or regulators.

BRIEF DESCRIPTION OF THE DRAWINGS

FIG. 10 illustrates an embodiment of the control of FIG. 9, in which the control wheel is only supported against movements toward the rotating grinding member.

FIG. 11 illustrates separate servo motors to be used in combination with position controls as illustrated in FIGS. 9, 10 and 17.

DETAILED DESCRIPTION OF THE PREFERRED EMBODIMENT

Figure 1:
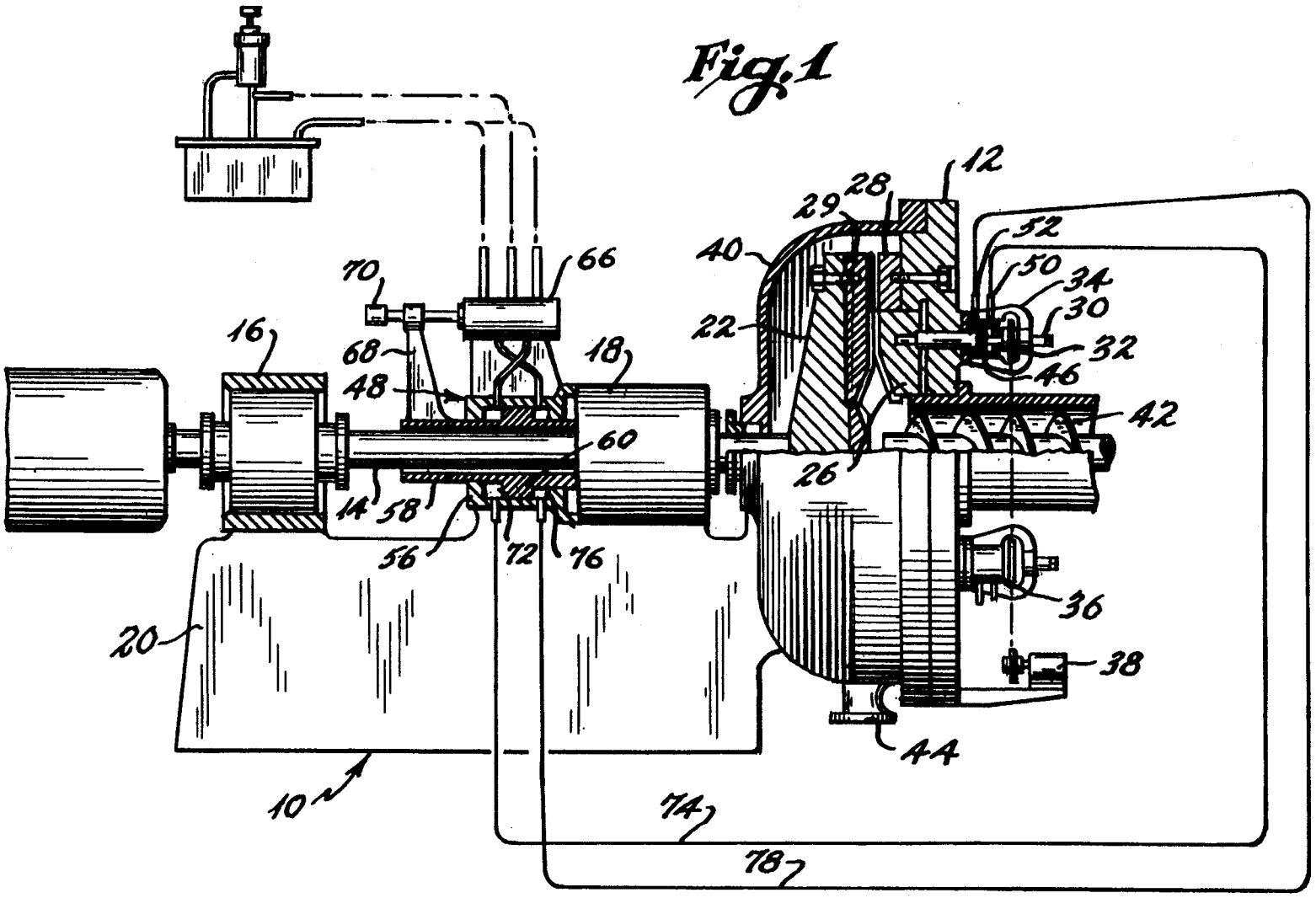
FIG. 1 is a longitudinal view, partially in cross-section, of a grinding apparatus in accordance with the present invention having two-sided servo motors.

The present invention will now be described in detail with reference to the drawings.

In the drawings, the present method and device are shown in combination with a grinding apparatus which includes a refiner for treating fibrous material such as wood chips, sawdust or wood shavings. It will be apparent to those skilled in the art, however, that the present invention can be applied to other fields of use as well.

FIG. 1 illustrates a grinding apparatus 10 having a rotatable shaft 14 supported in two bearing housings 16 and 18, all being mounted in a base frame 20. The bearing housings are arranged so that the rotatable shaft is axially displaceable. U.S. Pat. No. 3,212,721 describes further details in addition to those disclosed herein and illustrated in the drawings. The shaft 14 carries a rotor 22 provided with a grinding disc 24. Both the rotor 22 and the grinding disc 24 are rotatable together with the shaft 14. Located opposite to the rotatable grinding disc 24 are two non-rotatable grinding members 26,28 fastened to a circular stator 12. These non-rotatable grinding discs consist of one axially adjustable annular ring 26 and one outer non-adjustable grinding member 28 in the form of a ring or disc both supported in the stator 12. The outer annular disc 28 is rigidly fastened to the stator 12 in a fixed axial position, while the inner annular ring 26 is axially adjustable and fastened to the stator 12 by multiple threaded set screws 30. The axial positions of the set screws are adjusted and set by rotating the threaded and interconnected position control wheels 32.

The position control wheels 32 are mounted within an enclosure bracket 34 (FIGS. 1 and 7) which is rigidly secured to the stator 12, either directly or via a hydraulic cylinder permitting rotation of the threaded wheels 32 in a fixed axial position, thereby adjusting the axial position of the threaded screws 30 and the annular grinding member 26. There are preferably two and, more preferably, three or more set screws 30, each preferably equipped with interconnected positioning wheels 32 driven by a common adjusting drive 38.

The grinding discs 24,26,28 are enclosed by a casing 40 and stator 12 which form a housing. Material which is to be ground is supplied to the apparatus 10 through a central inlet channel 42 connected to the center of an inlet opening of the housing 40,12, and is fed into the space between the grinding discs 24,26,28. It is there ground by the generation of heavy axial forces on the grinding members, and the ground material is discharged from the housing 40 through a discharge opening 44.

To counteract the heavy axial forces exerted on the non-rotatable annular grinding member 26 and the set screws 30 with its threaded positioning wheel 32, a plunger 46 (FIGS. 1 and 7) enclosed in a cylinder 36 is placed between the stator 12 and the enclosure brackets 34 for the threaded positioning wheels 32.

The cylinder 36 with plunger 46 carrying the positioning wheels 32 with its set screws 30, is fastened in the stator 12 and thus, when hydraulically activated, absorbs the axial forces transferred to the annular grinding member 26 from the rotating side main servo motor.

The pressure in the cylinder housing 36 with its hydraulic pressure chambers 50 and 52 (FIGS. 7 or 8), is either directly or indirectly connected to, or governed by, the pressure in the main servo motor 48 with its pressure chambers 72,76 which controls the axial position of the rotating shaft 14 with the grinding member 24.

The main servo motor 48 is concentrically mounted around the shaft 14 and is rigidly secured to the bearing in casing 18 which controls the axial position of the shaft 14. The servo motor 48 comprises a casing or cylinder 56 which may be integral with the bearing casing 18, and a piston 58 which concentrically and loosely surrounds the shaft 14. The front end thereof is rigidly fastened to the shaft positioning control bearing in casing 18. The piston 58 has a central flange 60 which divides the cylinder 56 into two separated hydraulic pressure chambers 72 and 76. A hydraulic pressure medium is maintained within the pressure chambers by a pilot valve 66 to create sufficient axial forces to maintain the shaft 14 and the rotatable grinding member 24 in their desired positions.

The pilot valve 66 is described in detail, for example, in U.S. Pat. Nos. 2,971,704 and 4,073,442. It is rigidly secured to the casing 18, and is actuated by an arm 68 with a set screw 70 working against the end of the piston of the pilot valve. The arm is attached to the servo motor piston 58 and moves axially therewith.

The pilot valve 66 is actuated by the axial movement of the rotating shaft through the servo motor piston 58, and creates simultaneous changes of the hydraulic pressures in the opposing pressure chambers 72 and 76 of the servo motor 48, thereby counteracting all of the axial movement of the shaft caused by changes in the axial grinding load between the rotating and stationary grinding members and always maintaining the shaft in a predetermined position.

By utilizing the hydraulic balancing pressures of the pressure chambers 72 and 76 in the main shaft servo motor 48 in similar hydraulic devices placed separately or in combination with the set screws 30 for the non-rotating annular grinding member 26, it is possible to instantaneously hydraulically counterbalance all axial forces of varying magnitude transferred from the rotating grinding member 24 to the non-rotating annular grinding member 26.

The multiple stator servo motors 36 mounted either separately or in combination with the set screws 30 for the control of the annular grinding member 26, preferably have the same, or approximately the same, area proportions between opposing areas as the main hydraulic servo motor 48 for the rotating grinding member, but with their combined active areas reduced to correspond to the area proportion of the controlled annular grinding member 26 compared to the total non-rotating grinding area of the stator 26+28.

The main servo motor chamber 72 is connected to the chamber 50 by a line 74, and the chamber 76 of the rotary side servo motor is connected to chamber 52 of the stator side servo motor by a line 78.

With the present invention, the heavy axial loads on the set screws 30 for the annular grinding member 26 are controlled and always counteracted by the combined effect of the stator side and the rotary side servo motors and all grinding load variations will instantaneously be balanced. This eliminates the high axial loads that have previously been absorbed entirely by the threaded axial positioning control 32 and 30, which as a result minimizes the frictional forces and wear of the adjusting means for controlling the annular stator grinding member.

The transfer of pressure from the main rotary side servo motor to the stator side servo motor can either be direct as described above, or indirect by intermediate pressure control equipment of mechanical, hydraulic, pneumatic, electric or electronic function, or be computer-controlled. The pressures transferred will be governed by the pressure in the rotary side servo motor, or a separate source of hydraulic supply may be used where the pressure from the main servo motor 48 will act only as a governing signal component for the control of pressure supplied to the stator servo motors.

In FIGS. 2–17, all elements which are common to the embodiment illustrated in FIG. 1 have the same reference numerals. Elements which are altered may have the number 1 or higher before the reference numeral used in FIG. 1, and new added elements have new reference numerals.

Figure 2:
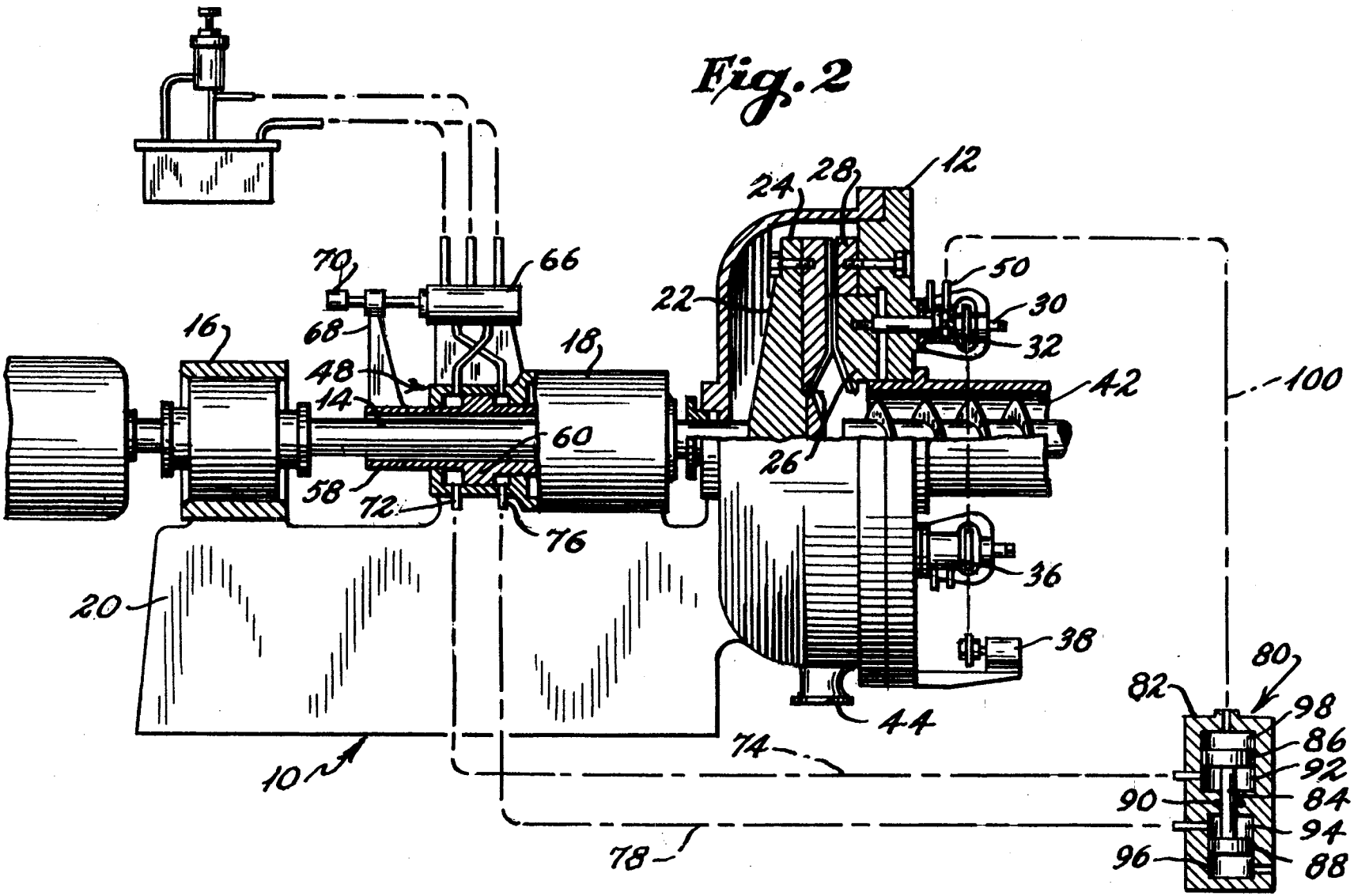
FIG. 2 is a longitudinal view, partially in cross-section, of a grinding apparatus in accordance with the present invention having a two-sided main servo motor which, via one type of a pressure converter, is connected to one-sided servo motors for an adjustable stator grinding member.

FIG. 2 illustrates an embodiment of the present invention including a two-sided main servo motor 48 for position control of the rotary shaft as described above. The pressure is transformed to a resulting pressure by way of a hydraulic converter 80 which, when connected to one-sided servo motors with adjusted area for the control of the stator annular ring 26, will in the same way as described above, provide full counterbalancing of the axial loads on the set screws.

The pressure converter shown in FIG. 2 is an embodiment of a conventional hydraulic converter wherein the outgoing pressure is the resultant of the two ingoing and opposing pressures from the servo motor 48. The pressure converter 80 includes a cylinder 82 containing a piston 84 which is equipped with two end flanges or pistons, 86,88, which are hydraulically separated by a centrally located pressure tight seal 90. The areas of these two flanges may have the same ratio with respect to each other as the areas of the piston 60 in the rotary side position controlling servo motor 48.

The pressure chamber 92 of the converter is connected to the main servo motor chamber 72 by line 74 and the opposing chamber 94 is connected to the main servo motor chamber 76 by line 78. Thus, the resulting axial force on the piston 84 in the pressure converter 80 will always change in proportion to the axial force transmitted to the rotary shaft 14 with its grinding member 24 by the main servo motor 48.

The chamber next to the smaller flange 88 communicates to the atmosphere, while the chamber 98 next to the larger flange 86 is filled with a hydraulic medium and is pressure tightly connected to chamber 50 of the servo motor 36 (FIG. 7 or FIG. 8) controlling the annular stator ring 26 by line 100.

The resulting hydraulic pressure in chamber 98, line 100 and chamber 50 always produces a counteracting axial force on the set screws 30 corresponding to the axial forces projected thereon from the servo motor for the rotary grinding member 24. As described above, this results in minimized frictional forces on, and wear of, the adjusting mechanism for the controlled annular ring 26.

Figure 3:
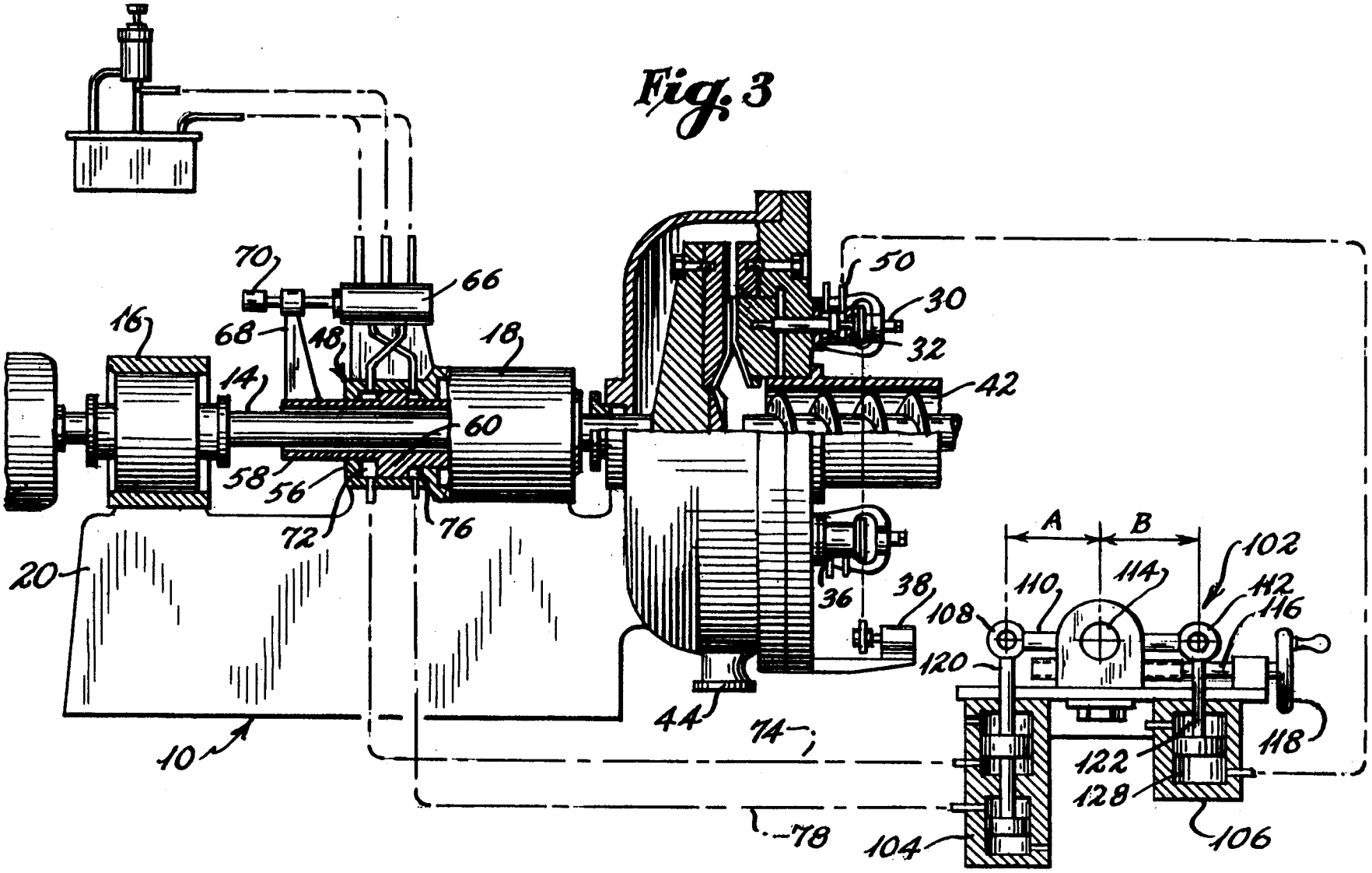
FIG. 3 illustrates an adjustable pressure converter of the type shown in FIG. 2, for use with one-sided stator servo motors.

FIGS. 2 and 3 illustrate an embodiment of adjustable pressure converters which enables the adjustment of the total counteracting force transferred from the rotary side servo motor 48 to the balancing servo motors for the stator set screws 30.

By changing the type of grinding tools and/or the grinding distance between the rotary and stationary grinding members, the axial forces projected on the controlled annular grinding member may be changed to some extent. Although the changes are relatively small and well within the limits for safe and problem-free operation, with set screws 30 equipped with the hydraulic counterbalancing servo motors in accordance with the present invention (FIGS. 1 and 2), an adjustable pressure converter (FIG. 3) may be used to precisely adjust the forces transferred from the rotary main servo motor 48 to the stator set screws 30 to within a minimal deviation from the actual forces projected thereon.

The adjustable pressure converter 102 shown in FIG. 3 may comprise two independent hydraulic cylinders 104 and 106 that are interconnected by a link system 108,110,112 having an adjustable length for levers A and B. Adjustment is made by changing the position of the balance point 114 using a threaded control rod 116 having a rotatable handle 118.

Figure 7:
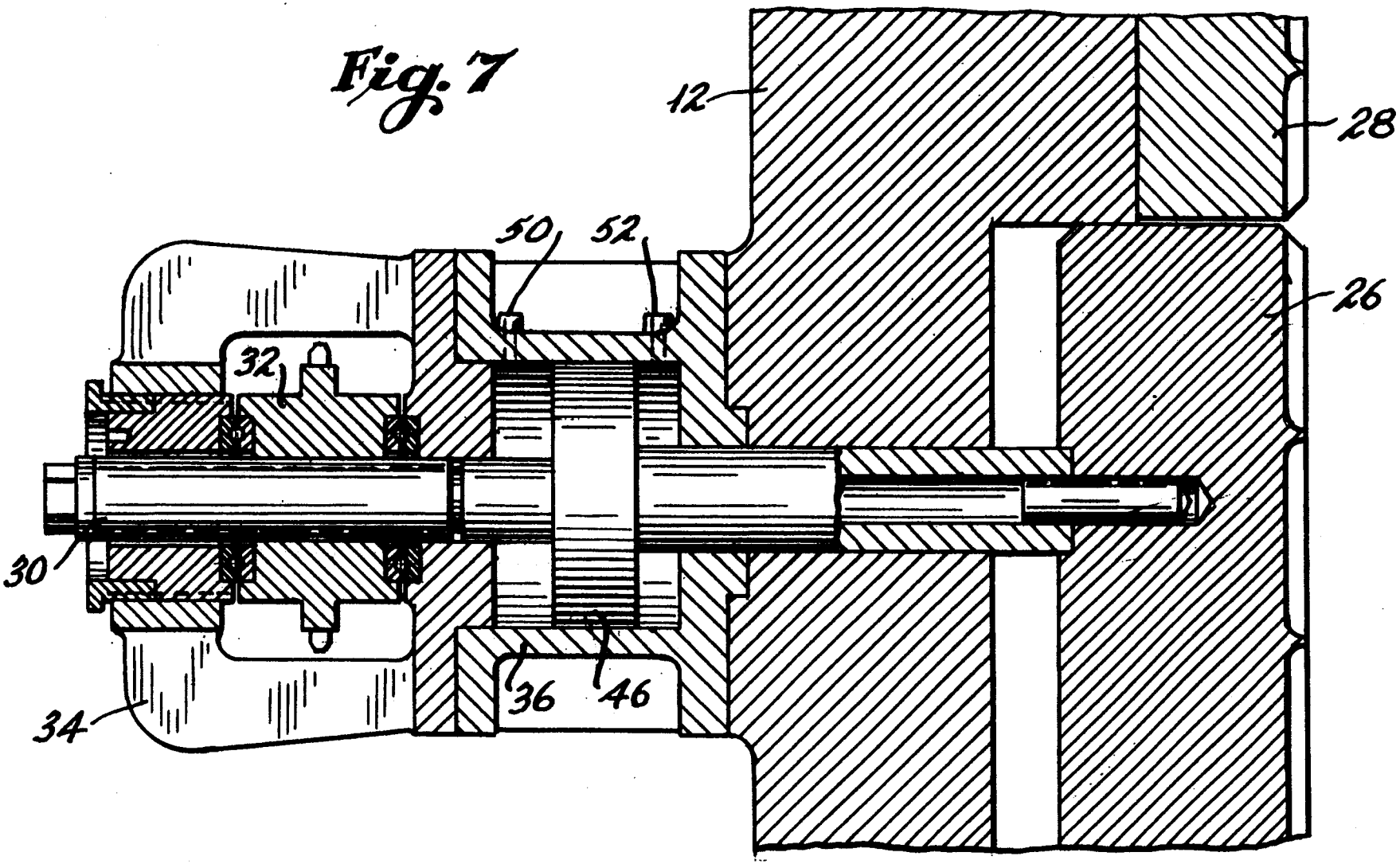
FIG. 7 illustrates an embodiment of a stator servo motor with combined position control by use of a threaded control wheel supported in a fixed axial position outside the servo motor plunger.
Figure 8:
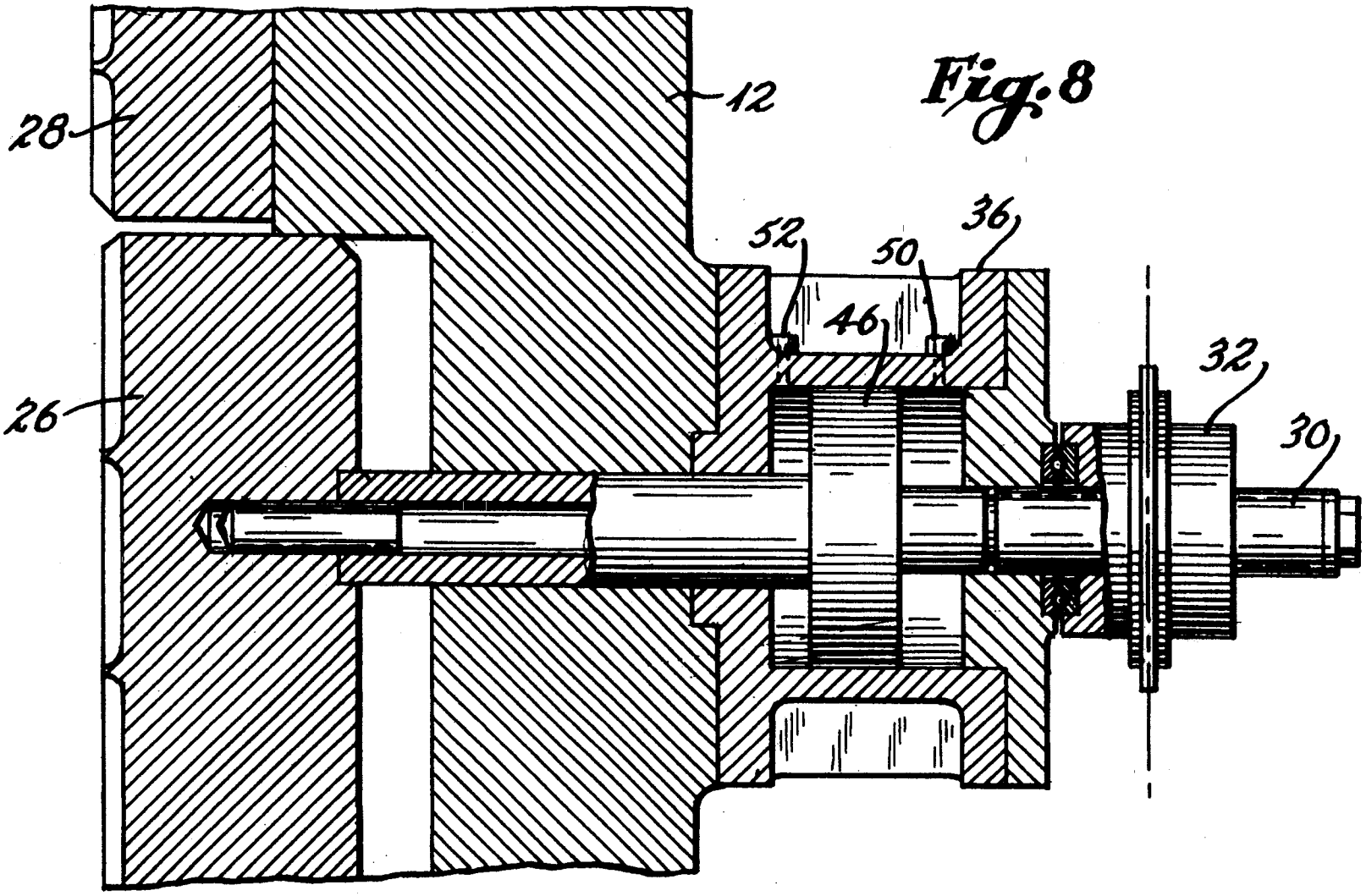
FIG. 8 illustrates a stator servo motor similar to that of FIG. 7 in which the threaded control wheel is supported only in the direction towards the rotating grinding member.

The hydraulic cylinder 104 is of the same general type as shown in FIG. 2, and has the same area relationship as the main servo motor 48. The piston 120, however, is prolonged in length, and through a linkage 108 is connected to another hydraulic piston 122 within cylinder 106. The resulting hydraulic pressure in chamber 128 is connected to chamber 50 in the stator servo motors, as shown in FIGS. 3, 7 and 8.

The resulting force transferred to the stator servo motors from the rotary side main servo motor is thus easily modified by changing the position of the balance point 114. For a lower transferred force, the balance point is moved closer to the piston 120 and, for increased force, in the opposite direction.

Figure 4:
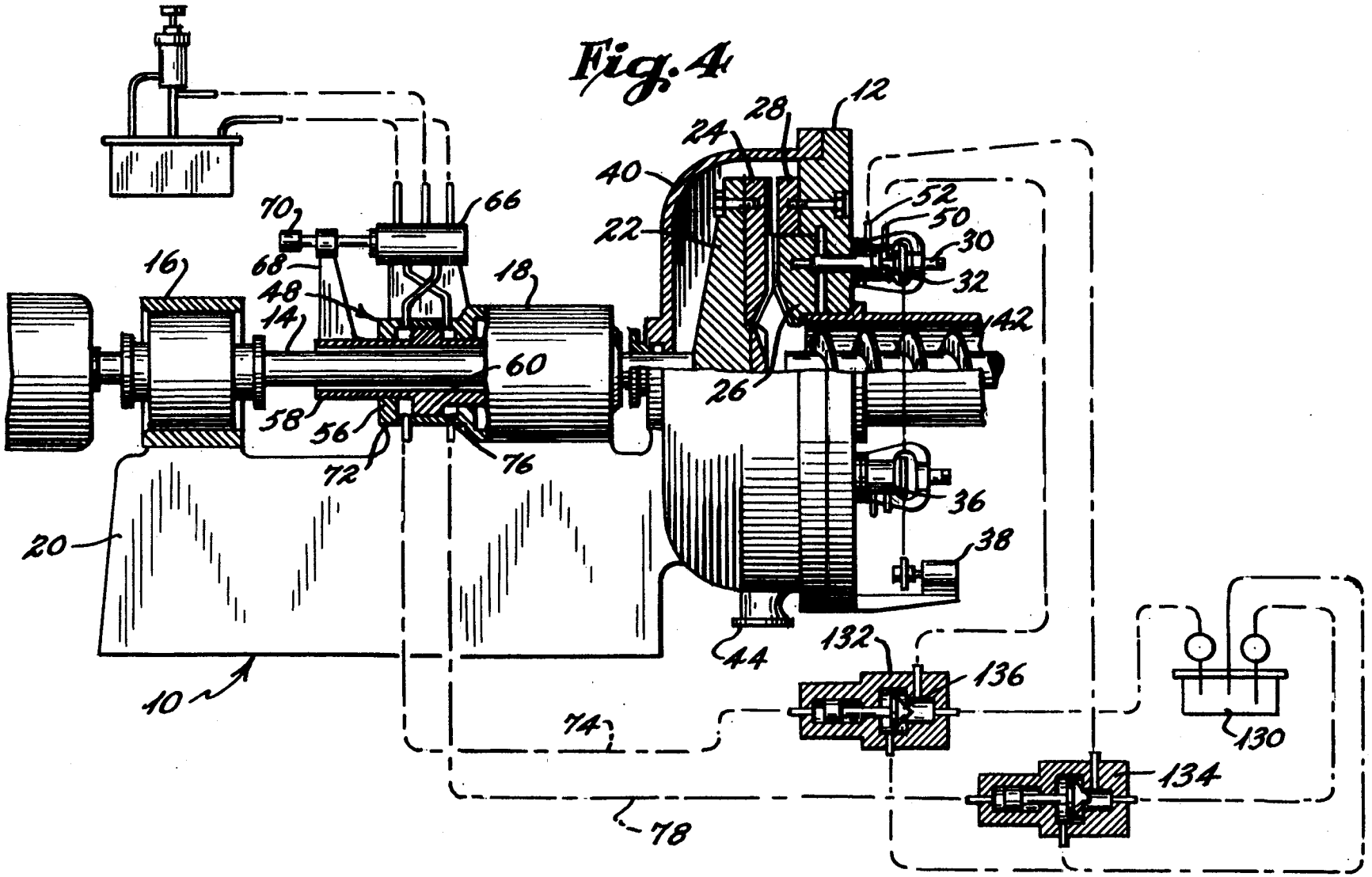
FIG. 4 illustrates a hydraulic system for the control of two-sided stator servo motors by use of a separate hydraulic medium supply which pressure is controlled by hydraulic pressure maintained in the shaft main servo motor.

FIG. 4 illustrates an embodiment of the present invention including a separate hydraulic pressure medium supply 130 for the control of the stator servo motors 36. The pressures are governed by the use of the pressure levels in the pressure chambers 76,72 of the main servo motor 48 as control signals for regulators 132 and 134. These regulators have a conventional design and the ratio of resulting pressures for the servo motors 36 can be adjusted to be equal to or higher or lower than, the signal pressures from the main servo motor 48 by varying the plunger areas or otherwise.

Figure 5:
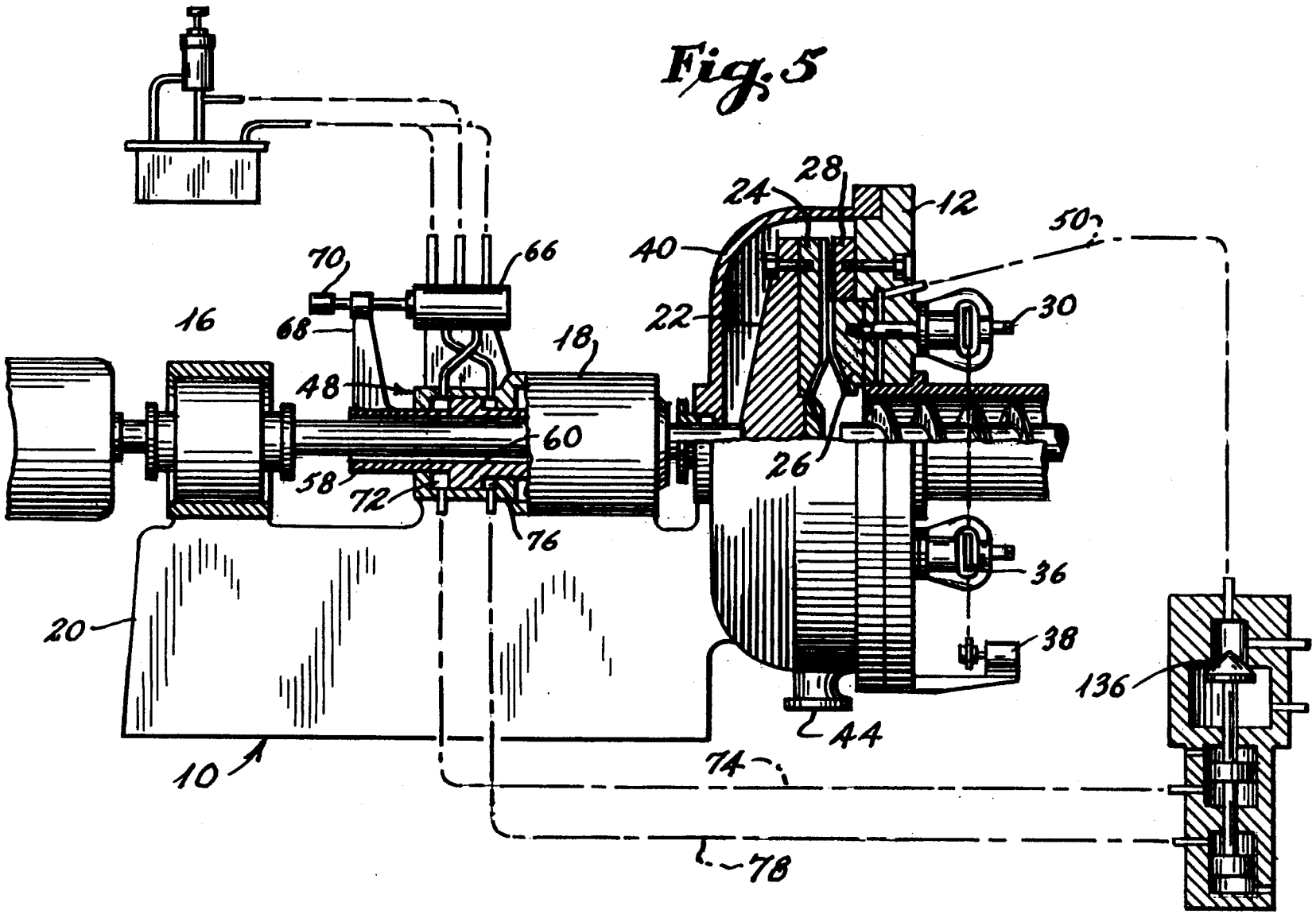
FIG. 5 illustrates a hydraulic system for the control of one-sided stator servo motors, by use of a separate hydraulic medium supply which pressure is controlled by the hydraulic pressure maintained in the shaft main servo motor.

For controlling one-sided stator servo motors as shown in FIGS. 2, 3 and 5, using a separate hydraulic pressure medium supply, one of the above-described pressure regulators 132 may be combined with the principle of the pressure converter 80 of FIG. 2, and the piston 84 is prolonged to control the pressure reducing valve 136 (see FIGS. 4 and 5).

It will be apparent to those skilled in the art that the above-described pressure converters or controls can be replaced by controls of any type, which permit the use of the principle of this invention; i.e., that the fluctuating hydraulic pressures in the main servo motor, controlling the axial forces projected on the rotating grinding member, can be utilized directly or indirectly, or act as a signal medium for controlling the pressurized medium supplied to the stator servo motors for instantaneously counteracting the likewise fluctuating axial forces projected on the adjustable non-rotating annular grinding members.

Figure 6:
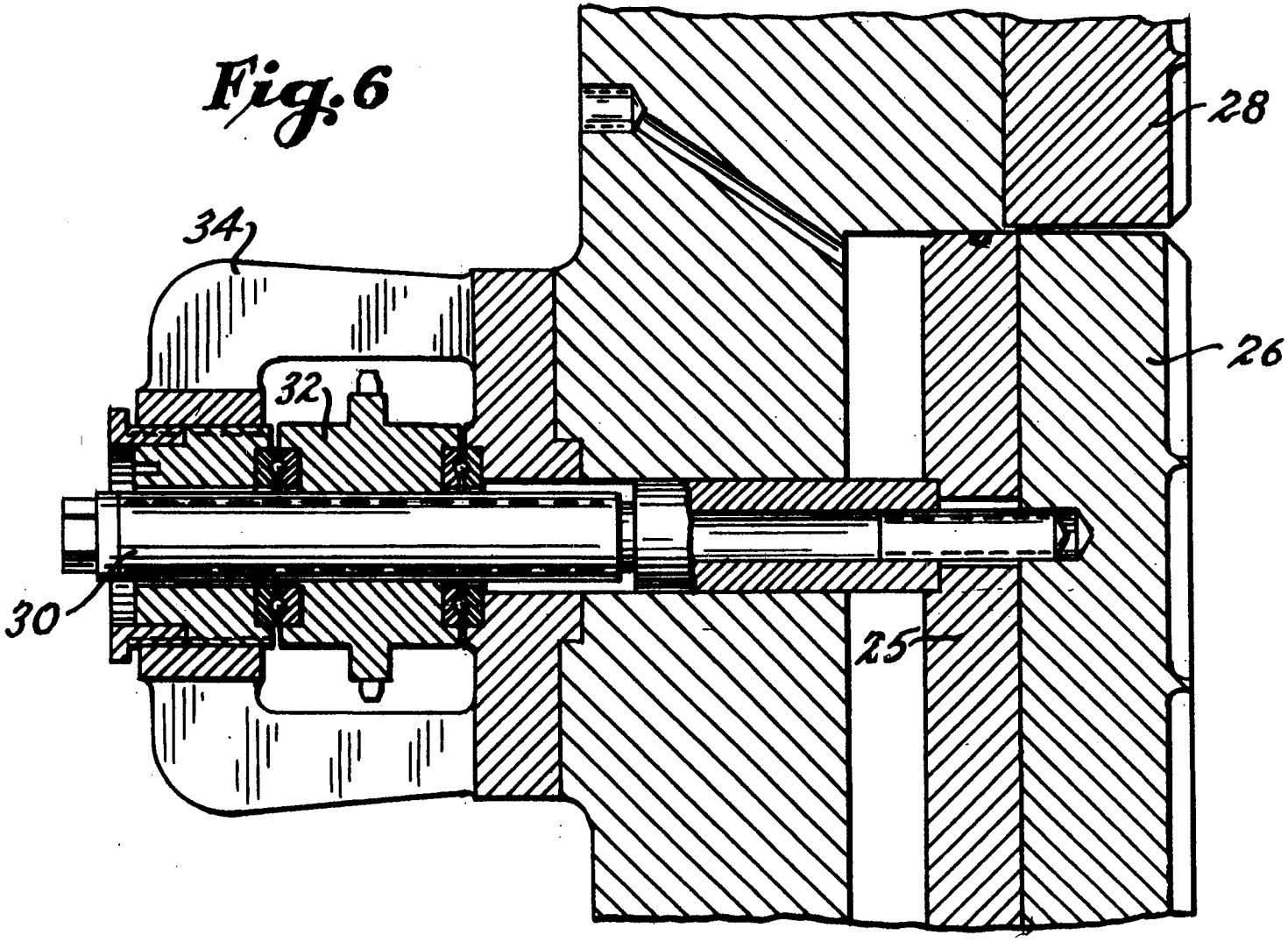
FIG. 6 illustrates an embodiment of the present invention including one annular central stator plunger for the transfer of the axial counterbalancing forces projected on the controlled annular grinding member.
Figure 9:
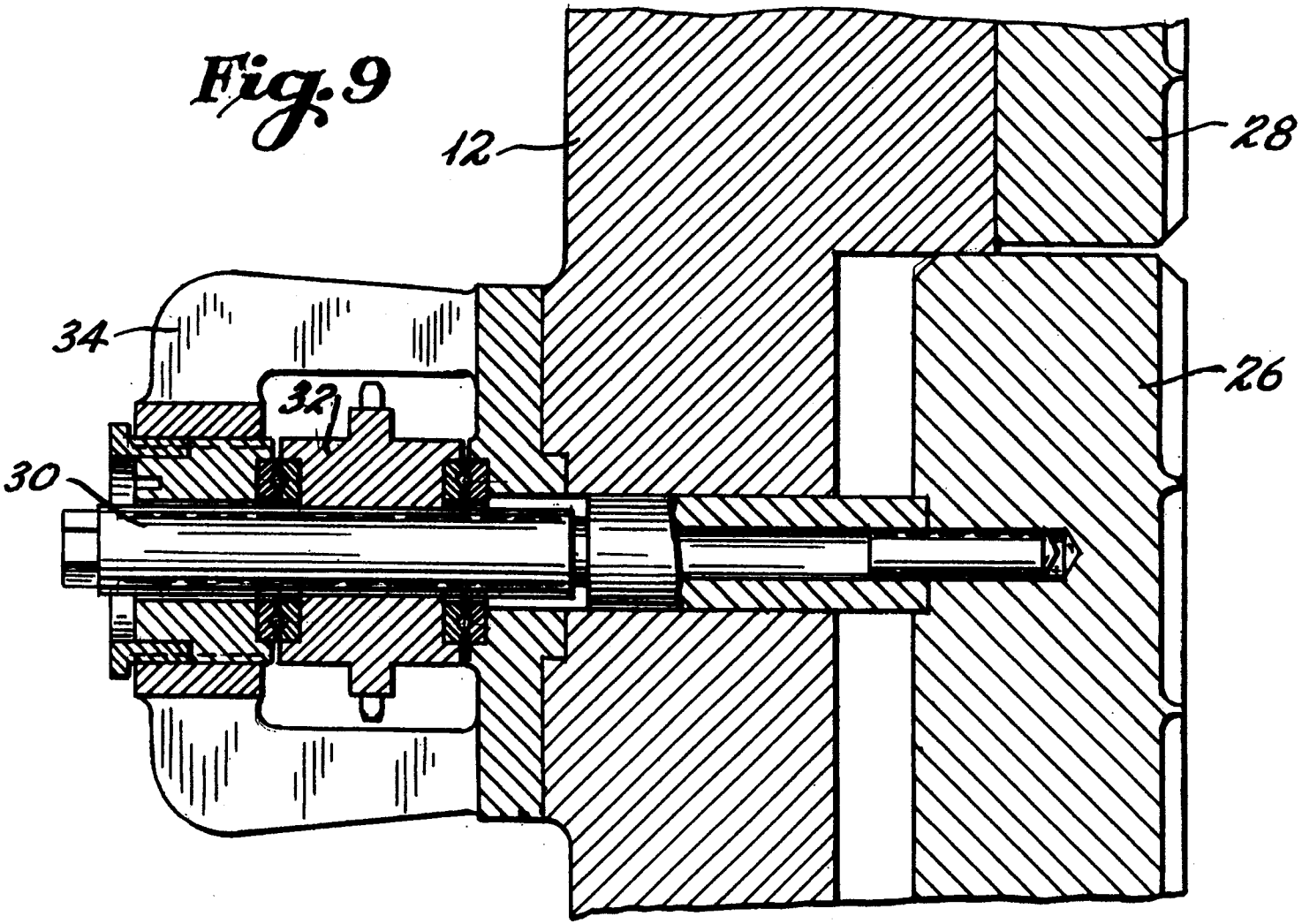
FIG. 9 illustrates an embodiment of a separate control for the axial position of the annular grinding member, with the threaded control wheel supported in a fixed axial position, and which arrangement is used in combination with separate servo motors as shown in FIG. 11, placed concentrically on and around the controlled annular grinding member or used in combination with a central servo motor as shown in FIGS. 6 and 17.

The above-described stator servo motors 36 can be replaced by a central stator servo motor as shown in FIG. 6, wherein a pressure medium of adjusted levels governed by the pressures in the shaft main servo motor 48, is introduced to the rear area of the non-rotating, axially adjustable grinding member 26, or to a connected annular ring plunger 25 having the same or adjusted area. The central servo motor is axially controlled by the set screws 30 as shown in FIGS. 9 and 10, and may receive a pressurized medium, transformed to the required level by the use of any of the above-described pressure converters and/or regulators, either directly or indirectly connected to the shaft main servo motor 48.

With the use of threaded control wheels that are supported only in the direction towards the rotating grinding member, it is necessary, in order to create and secure a stable position of the control wheel without outward axial vibrations, to adjust either the area proportions of the stator servo motor or motors or the pressure supplied to the outer servo motor chamber or chambers, to achieve a counterbalancing axial force that exceeds the axial forces between the rotating grinding members by a few percent.

Figure 12:
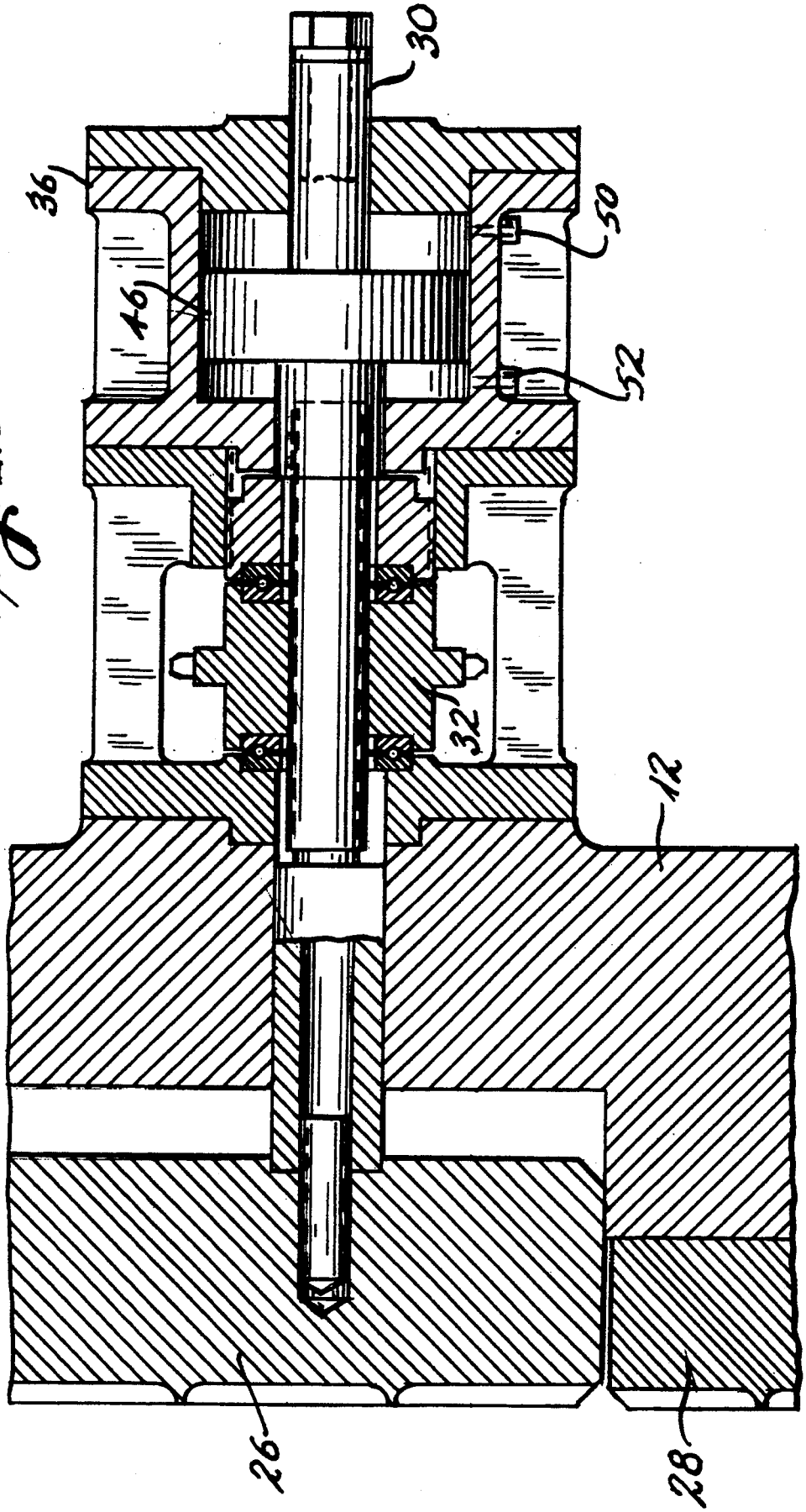
FIG. 12 illustrates an embodiment of a stator servo motor with combined position control by use of a threaded control wheel, supported in a fixed axial position between the stator and an outer servo motor.
Figure 13:
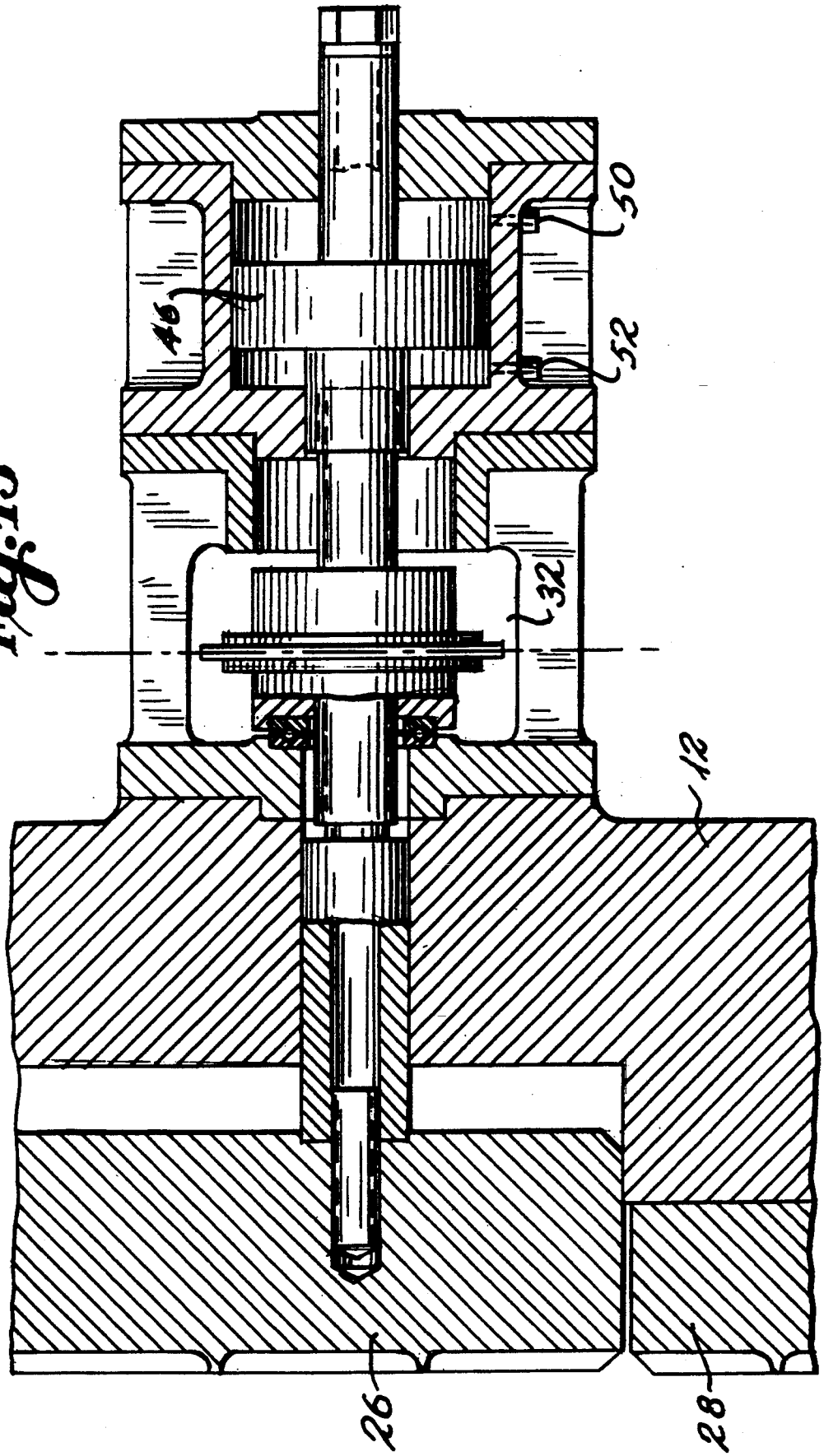
FIG. 13 illustrates an embodiment of a stator servo motor with combined position control, by use of a threaded control wheel supported in a fixed axial position only in the direction towards the rotating grinding member and placed intermediate the stator and an outer servo motor.
Figure 14:
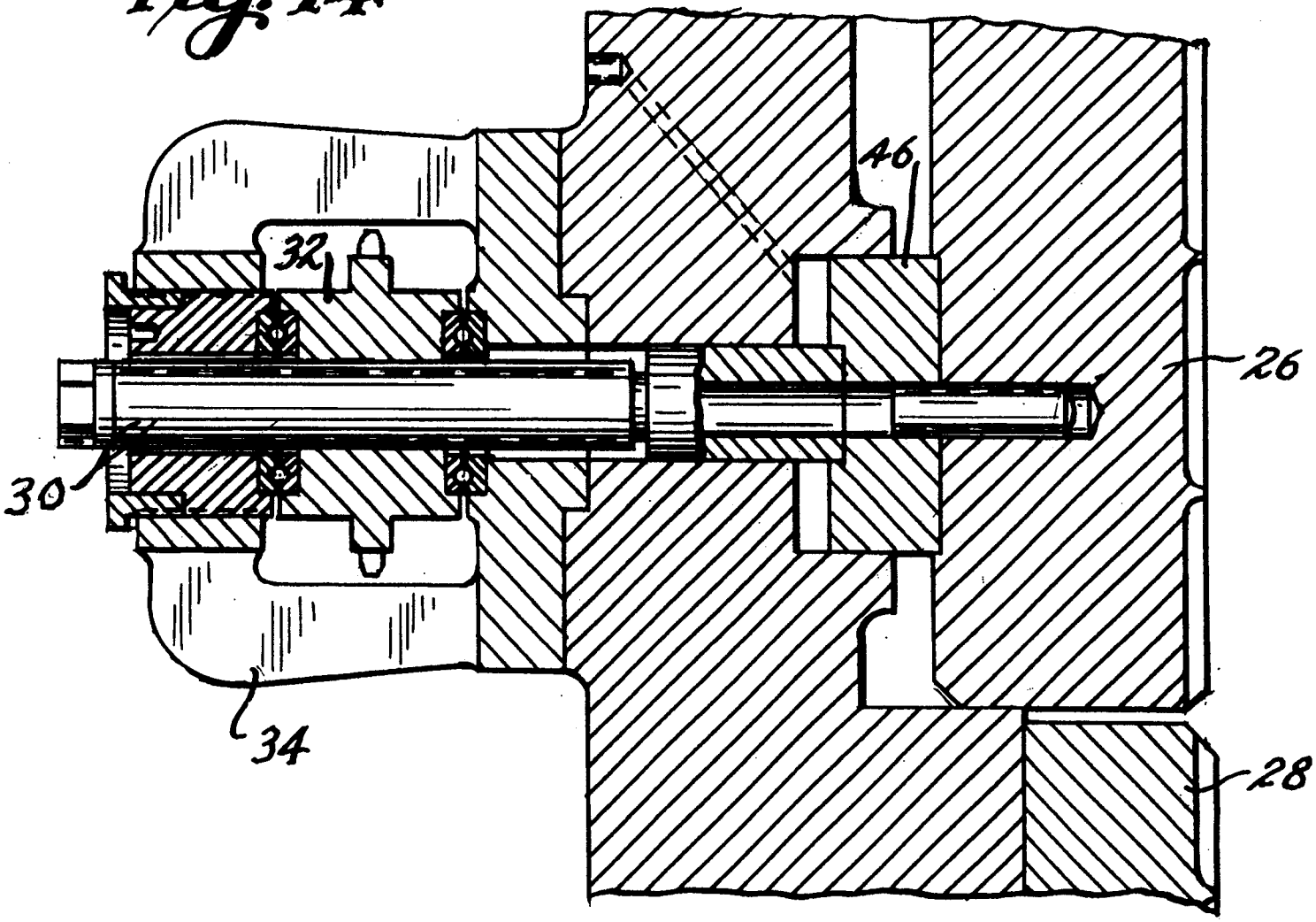
FIGS. 14 and 15 illustrate an embodiment of the present invention in which the servo motors are placed on the inside of the stator in combination with position controls placed on the outside of the stator.
Figure 15:
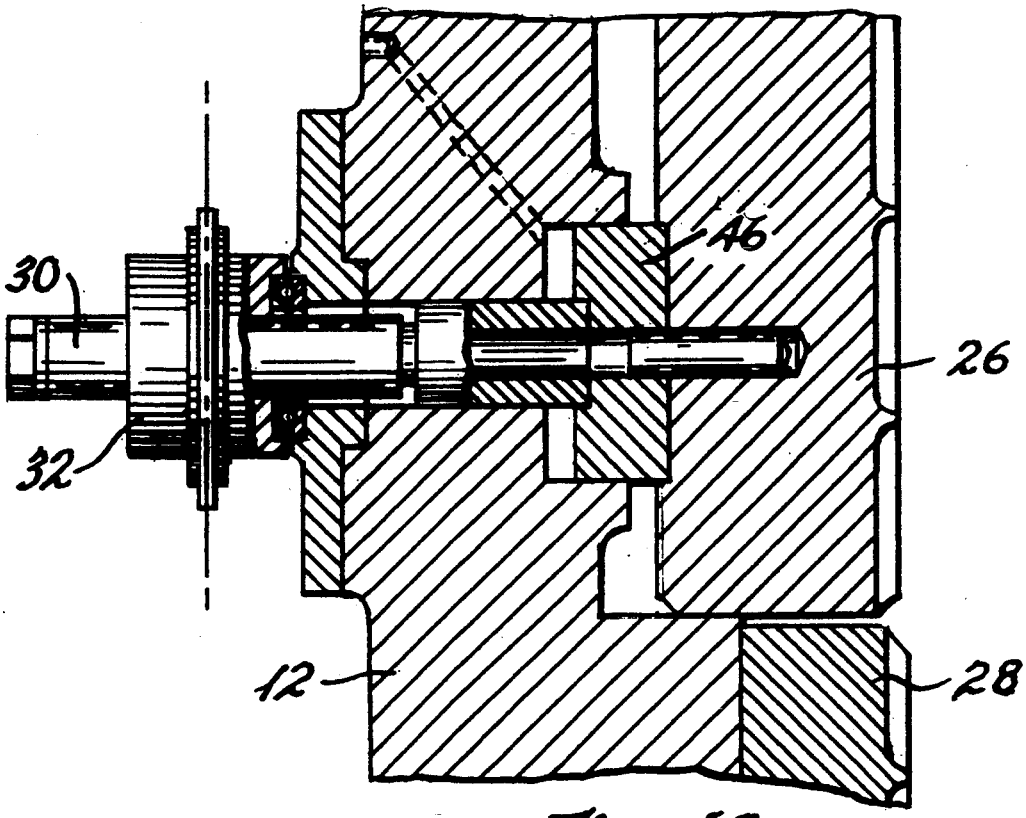
Figure 16:
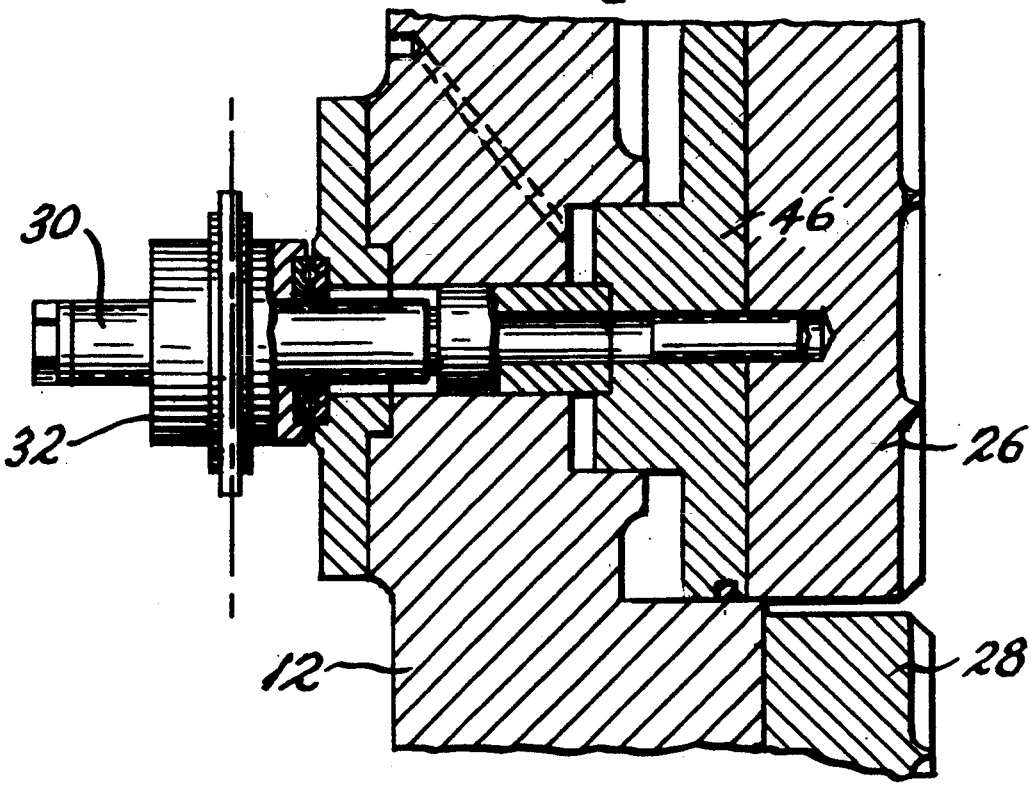
FIG. 16 illustrates the same embodiment as in FIGS. 14 and 15, and also including the use of annular concentrical plungers for the internal servo motors.
Figure 17:
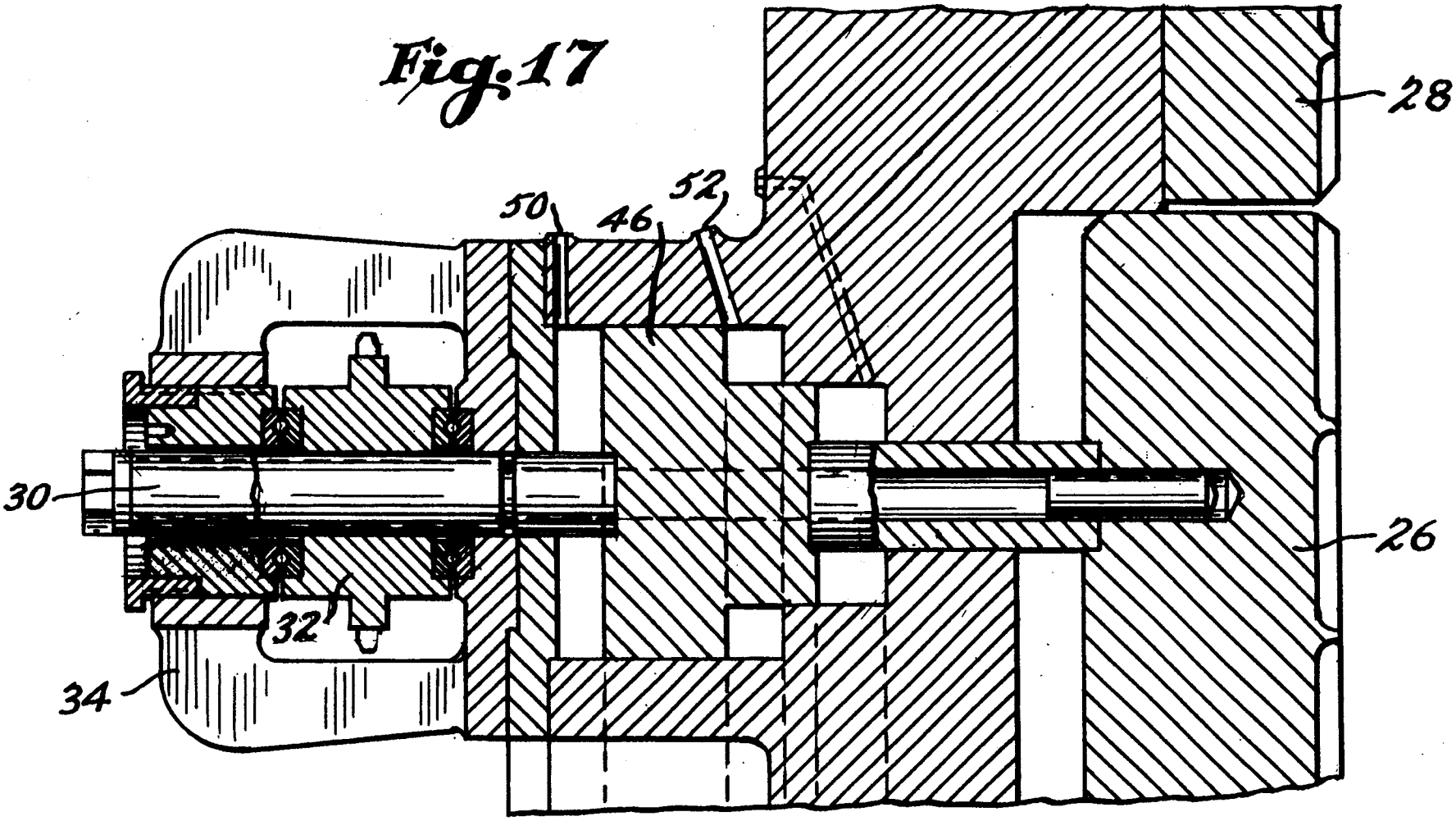
FIG. 17 illustrates the same embodiment as in FIG. 7, and also including an annular concentrical plunger for the external servo motor.

It will also be apparent as shown in FIGS. 12 and 13, that the above-described threaded stator position control wheels 32 can be placed between the stator 12 and an outer-placed servo motor 36, or as is shown in FIGS. 14, 15 and 16, that the servo motors can be placed on the inside of the stator and controlled by outside position controls, or as shown in FIG. 17, an annular concentrical servo motor plunger can be placed either inside or outside in the stator while being controlled in the same manner.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

What is claimed is:

1. A method of refining pulp stock, comprising the steps of:

introducing pulp material to be ground in a grinding process into a grinding space between a first rotatable grinding means carried by a shaft and being axially displaceable by a main servo motor, and a second non-rotatable grinding means, said main servo motor being actuated by pressurized fluid for adjusting and controlling the grinding space and for producing a grinding pressure between the first and second grinding means and for preventing axial displacement of the first rotatable grinding means relative to the second non-rotatable grinding means in response to fluctuating axial grinding forces, said second non-rotatable grinding means comprising a plurality of concentrically arranged annular grinding members at least one of which being axially adjustable by setting means; and absorbing at least some of the fluctuating axial forces generated from the grinding process that are projected on said setting means by using the pressure of a pressurized fluid of said main servo motor to provide a counter pressure on the second non-rotatable grinding means to reduce the axial forces on said setting means.

2. The method of claim 1 including the step of adjusting said pressure of the pressurized fluid of said main servo motor to achieve a counteracting force on the axially adjustable second non-rotatable grinding means which differs from the axial forces projected thereon.

3. The method of claim 1 including the step of adjusting said pressure of the pressurized fluid of said main servo motor by intermediate pressure control equipment selected from a group consisting of equipment having mechanical, hydraulic, pneumatic, electrical, electronic, and computer-controlled function.

4. The method of claim 1 including the step of using said pressure of the pressurized fluid of said main servo motor as a signal component for adjusting the pressure of the fluid used for achieving the counter pressure force.

5. The method of claim 1 including the step of varying the ratio of the areas of the main servo motor and the setting means which are exposed to the pressure of the pressurized fluid to obtain a desired counter pressure.

6. A grinding apparatus for refining pulp stock, comprising a grinding space into which pulp material to be ground is introduced, said grinding space being located between first rotatable grinding members carried by a shaft and being axially displaceable by a main servo motor and second non-rotatable grinding members, said main servo motor being actuated by pressurized fluid for adjusting and controlling said grinding space and producing a grinding pressure between said first and second grinding members and for preventing axial displacement of said first rotatable grinding members relative to said second non-rotatable grinding members in response to fluctuating axial grinding forces, said second non-rotatable grinding members including a plurality of concentrically arranged annular grinding members, at least one of which is axially adjustable by at least one setting means, and stator servo motors in which the pressure of the pressurized fluid is governed by the pressure of the main servo motor controlling said shaft and first rotatable grinding members.

7. The apparatus of claim 6, comprising a plurality of setting means, each of said setting means being individually adjusted for simultaneous adjustment of the axial position of at least one of said annular grinding members.

8. The apparatus of claim 7 including stator servo motors arranged in combination with said at least one axially adjustable setting means in a spaced relationship about the circumferences of the annular grinding members being controlled.

9. The apparatus of claim 7 including stator servo motor means arranged independently from said at least one adjustable setting means and in a spaced relationship about the circumferences of the annular grinding members being controlled.

10. The apparatus of claim 6, comprising a plurality of setting means, each of said setting means being coupled together for simultaneous adjustment of the axial position of at least one of said annular grinding members.

11. The apparatus of claim 10 including stator servo motors arranged in combination with said at least one axially adjustable setting means in a spaced relationship about the circumferences of the annular grinding members being controlled.

12. The apparatus of claim 10 including stator servo motor means arranged independently from said at least one adjustable setting means and in a spaced relationship about the circumferences of the annular grinding members being controlled.

13. The apparatus of claim 6, comprising a stator servo motor for each of the controlled annular non-rotating grinding members including one concentric central annular servo motor for each controlled annular non-rotating grinding member.

14. The apparatus of claim 13, in which each said stator servo motor for the controlled non-rotatable annular grinding members includes opposing pressure chambers, wherein the pressure of the fluid medium is directly or indirectly governed by fluctuating pressure in corresponding opposing pressure chambers of said main servo motor for the shaft and the rotating grinding member.

15. The apparatus of claim 13, in which each said stator servo motor for the controlled non-rotatable grinding members includes only one side of an actuated plunger subjected to pressurized fluid, and the pressure of the fluid is governed by the pressure of said main servo motor for the rotating shaft.

16. The apparatus of claim 15, in which the products of utilized fluid pressure multiplied by total area of the servo motor plungers controlling the non-rotatable annular grinding members are reduced from the same products of area and pressure levels maintained in the main servo motors for the shaft to a level corresponding to the axial grinding force being absorbed by the area of the controlled annular grinding member, pro rata compared to the total axial grinding force projected on the total area of the non-rotatable grinding members.

17. The apparatus of claim 6 including a positioning part for said at least one setting means and supported in a fixed axial position to prevent vibrational axial movement of said setting means, the product of servo motor area and fluctuating fluid pressure being different than the axial forces projected on the non-rotating grinding members.

18. The apparatus of claim 6, in which said setting means for the controlled annular grinding members is supported only in a direction towards the rotating grinding member, wherein to prevent vibrational axial movement in an outward direction, the products of servo motor area and fluctuating fluid pressure is higher than the axial forces projected on the non-rotating grinding member.

19. The apparatus of claim 6, in which said stator servo motors and said main servo motor each include a plunger having two sides, the two sides of the plunger of each stator servo motor having approximately the same area proportion as the two sides of the plunger of said main servo motor.

20. The apparatus of claim 6, in which the servo motors for the controlled non-rotatable annular grinding members have only one side of a servo plunger subjected to pressurized fluid received from a pressure converter means governed by the pressure in said main servo motor for the rotating shaft, in which said pressure converter transforms the counteracting pressures therein to one resultant pressure which, when supplied to a one-sided servo plunger with an adjusted area, gives a similar axial counteracting force to the controlled non-rotating annular grinding members as transferred thereto by the main servo motor controlled rotating grinding members.

21. The apparatus of claim 6, in which a pressure converter means is used to adjust the transferred pressures from the main servo motors of the shaft and rotating grinding members to levels corresponding to available total area of the servo motors controlling the non-rotatable annular grinding member.

22. The apparatus of claim 6, in which a pressure regulator means is used to adjust the transferred pressures from the main servo motors controlling the shaft and a rotating grinding member to levels corresponding to changes in axial forces projected on the controlled non-rotatable annular grinding member.

23. The apparatus of claim 6, in which the pressurized fluid for actuating the stator servo motors controlling the non-rotatable annular grinding members is received from pressure sources controlling corresponding pressure chambers of the main servo motor for the shaft and rotating grinding member.

24. The apparatus of claim 23, in which said pressure sources comprise pressurized fluid controlling corresponding pressure chambers of the main servo motor for the shaft and rotating grinding member.

25. The apparatus of claim 23, in which the pressurized fluid for actuating the stator servo motors is received from a separate independent pressure source which pressures are governed by the pressures of the pressure chambers of the main servo motor for the shaft and rotating grinding member through the use of pressure regulator means.

* * * * *